US006672268B2

(12) United States Patent
Ogawa et al.

(10) Patent No.: US 6,672,268 B2
(45) Date of Patent: Jan. 6, 2004

(54) METHOD AND APPARATUS FOR CONTROLLING ELECTROMAGNETIC DRIVING VALVE FOR INTERNAL COMBUSTION ENGINE

(75) Inventors: Kenji Ogawa, Tokyo (JP); Satoshi Wachi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 228 days.

(21) Appl. No.: 09/996,793

(22) Filed: Nov. 30, 2001

(65) Prior Publication Data

US 2002/0185099 A1 Dec. 12, 2002

(30) Foreign Application Priority Data

Jun. 12, 2001 (JP) ..... 2001-177145

(51) Int. Cl.[7] ..... F02N 17/00
(52) U.S. Cl. ..... 123/179.3; 123/182.1
(58) Field of Search ..... 123/179.1, 179.3, 123/179.4, 182.1, 90.11

(56) References Cited

U.S. PATENT DOCUMENTS 4,558,677 A * 12/1985 Hara ..... 123/680
4,655,181 A * 4/1987 Ohtaki et al. ..... 123/686
6,332,454 B1 * 12/2001 Itabashi et al. ..... 123/490
6,460,500 B1 * 10/2002 Ooyama et al. ..... 123/179.3
6,488,007 B2 * 12/2002 Satou et al. ..... 123/396
6,546,910 B2 * 4/2003 Tanaka et al. ..... 123/348

FOREIGN PATENT DOCUMENTS

JP 9-303122 11/1997
JP 2000-97059 4/2000

* cited by examiner

*Primary Examiner*—John Kwon
(74) *Attorney, Agent, or Firm*—Sughrue Mion, PLLC

(57) ABSTRACT

An engine with an electromagnetic driving valve reduces a loss during a cranking operation to shorten a starting time, reduce an electric power consumption for a starter motor, and prevent an interference between a valve system and a piston. Intake and exhaust valves are sequentially excited and started such that, after starting the cranking operation by a starter motor, a first cranking rotating speed can be reached, and the valves can be all closed at a predetermined cranking angle. All intake and exhaust valves are closed and the cranking rotating speed reaches an ignition point by the supply of a fuel and the continuous operation of the engine can be performed at more than a second cranking rotating speed, and the intake and exhaust valves can be switching controlled in the normal cylinder process.

12 Claims, 11 Drawing Sheets

METHOD AND APPARATUS FOR CONTROLLING ELECTROMAGNETIC DRIVING VALVE FOR INTERNAL COMBUSTION ENGINE

BACKGROUND OF THE INVENTION

1. Field of the Invention

The present invention relates to a method and an apparatus for controlling an electromagnetic driving valve for an internal combustion engine for use as an intake and exhaust valve in an internal combustion engine, and more specifically to the electromagnetic valve driving control technology in starting the engine.

2. Description of the Prior Art

It has been conventionally known that an electromagnetic valve is designed to displace an intake and exhaust valve supported in a neutral position with elasticity using a spring between an all-closed position and an all-opened position by using the electromagnetic force. Furthermore, various methods such as a starting sequence, etc. have been disclosed for starting control of an electromagnetic valve for use in starting an engine.

In the method of starting an electromagnetic valve, as described in Japanese Patent Laid-Open No. 9-303122, an electromagnetic valve initially in the neutral position is normally started by exciting the intrinsic vibration of a spring mass system of the electromagnetic valve for displacement to the all-closed position or the all-opened position. In this case, unlike opening or closing a mechanical cam, starting control is required.

Japanese Patent Laid-Open No. 9-303122 discloses an example of starting control of an electromagnetic valve to be started by setting the starting time of an electromagnetic valve in an area of a crank angle, at which the time required for the electromagnetic valve started for excitation to reach the all-closed position and maintain the position can be shorter than the time required for a piston to reach the position of the interference caused by the body of the electromagnetic valve by the rotation of the crank shaft, so that the excited electromagnetic valve cannot come in conflict with the piston after starting the cranking of an engine.

Furthermore, Japanese Patent Laid-Open No. 2000-97059 discloses an example of starting control of an electromagnetic valve by, unlike the above mentioned example, displacing the electromagnetic valve to the all-opened position when the ignition switch is turned on, then the cranking of the starter motor is started, and the all-opened state of the electromagnetic valve is maintained until the number of cranking rotations reaches the reference number of rotations to reduce the compressing operation during the cranking process.

BRIEF SUMMARY OF THE INVENTION

Object of the Invention

However, in the example of the above mentioned Japanese Patent Laid-Open No. 9-303122, as pointed out in Japanese Patent Laid-Open No. 2000-97059, a very large compressing operation occurs immediately after the all-closed state is entered depending on the crank angle at which the intake and exhaust valve is all closed in the method of displacing the intake and exhaust valve to the all-closed position during the cranking process. Therefore, a starter motor durable of the compressing operation is required. That is, a starter motor controlled by an inverter is limited in output torque by the capacity of the power element. As a result, an internal combustion engine only having such a starter cannot be satisfactorily used.

Furthermore, in the example of the above described Japanese Patent Laid-Open No. 2000-97059, the electromagnetic valve is maintained in the all-opened position before the starter motor is turned on. Therefore, by the influence of the rushing current immediately after the starter motor is turned on, the support of the electromagnetic valve can possibly be removed. In addition, if the cranking process is performed with the valve opened, the interference between the intake and exhaust valve and the piston cannot be avoided as pointed out by the above described Japanese Patent Laid-Open No. 9-303122, thereby requiring a recess in the piston to avoid the interference. Furthermore, when the cranking process is performed with the valve opened, a pumping loss occurs.

The present invention has been developed to solve the above mentioned problems, and aims at obtaining a method and an apparatus capable of starting an engine with a starter motor having a small output torque, and controlling the electromagnetic valve for an internal combustion engine not requiring a recess in the piston.

SUMMARY OF THE INVENTION

A method for controlling an electromagnetic driving valve for an internal combustion engine according to claim 1 of the present invention includes the steps of: starting cranking a crank shaft by a starter; sequentially starting the excitation of intake and exhaust valves such that the valve can be all closed at a predetermined crank angle after the rotating speed of the crank shaft has reached a first predetermined rotating speed; starting switching control of an intake and exhaust valve according to the normal process of each cylinder under the condition of the above mentioned intake and exhaust valve closed, and the rotating speed of the crank shaft exceeding a second predetermined rotating speed; and transferring to normal control.

The method for controlling the electromagnetic driving valve for the internal combustion engine according to claim 2 of the present invention sets the above mentioned predetermined crank angle so that the valve closing crank angle of the last closed electromagnetic driving valve in at least each cylinder can indicate substantially equal values between the compressed task amount and the expanded task amount from the crank angle.

The method for controlling the electromagnetic driving valve for the internal combustion engine according to claim 3 of the present invention includes the step of prohibiting power supply to the starter from the starting time of closing valve to the ending time of closing valve for the electromagnetic driving valve.

The method for controlling the electromagnetic driving valve for the internal combustion engine according to claim 4 of the present invention includes the step of amending the first predetermined rotating speed based on the level of the load of the engine.

The method for controlling the electromagnetic driving valve for the internal combustion engine according to claim 5 of the present invention includes the step of computing the necessary output to the starter to drive the load of the engine, and the step of driving the starter based on the computed output from the starting time of closing valve to the ending time of closing valve for the electromagnetic driving valve.

In the method for controlling the electromagnetic driving valve for the internal combustion engine according to claim 6 of the present invention, the normal switching control of the intake and exhaust valve starts with an exhausting process.

The apparatus for controlling the electromagnetic driving valve for the internal combustion engine according to claim 7 of the present invention supports the intake and exhaust valve in the neutral position with elasticity using an elastic material, and displaces the intake and exhaust valve into the all-closed position or the all-opened position using the electromagnetic force. The apparatus includes: rotating speed detection means for detecting the rotating speed of a crank shaft based on the output of a crank angle sensor; and start control means for controlling an intake and exhaust valve such that the intake and exhaust valve can maintain its all-closed status at a predetermined crank angle after the rotating speed of the crank shaft has reached a first predetermined rotating speed set in advance depending on the necessary task amount required to make a rotation of the crank shaft after the inertia around the crank shaft and the intake and exhaust valve has entered the all-closed state. With the configuration, the switching control of the intake and exhaust valve is started depending on the normal process of each cylinder with the intake and exhaust valve maintained in its all-closed position, and the rotating speed of the crank shaft exceeding a second predetermined rotating speed.

The apparatus for controlling the electromagnetic driving valve for the internal combustion engine according to claim 8 of the present invention sets the above mentioned crank angle so that the valve closing crank angle of the last closed electromagnetic driving valve in at least each cylinder can indicate substantially equal values between the compressed task amount and the expanded task amount from the crank angle.

The apparatus for controlling the electromagnetic driving valve for the internal combustion engine according to claim 9 of the present invention includes first starter control means for prohibiting power supply to the starter from the starting time of closing valve to the ending time of closing valve for the electromagnetic driving valve.

The apparatus for controlling the electromagnetic driving valve for the internal combustion engine according to claim 10 of the present invention includes: load detection means for detecting the level of the load of an engine; and target rotation speed amendment means for amending the first predetermined rotating speed based on the level of the load.

The apparatus for controlling the electromagnetic driving valve for the internal combustion engine according to claim 11 of the present invention includes: load drive computation means for computing the necessary output to the starter to drive the load; and second starter control means for driving the starter motor based on the computed output of the load drive computation means.

In the apparatus for controlling the electromagnetic driving valve for the internal combustion engine according to claim 12 of the present invention, the normal switching control of the intake and exhaust valve is started with the exhausting process.

DETAILED DESCRIPTION OF THE PREFERRED EMBODIMENTS

The embodiments of the present invention will be described below by referring to the attached drawings.

Embodiment 1

Figure 1:
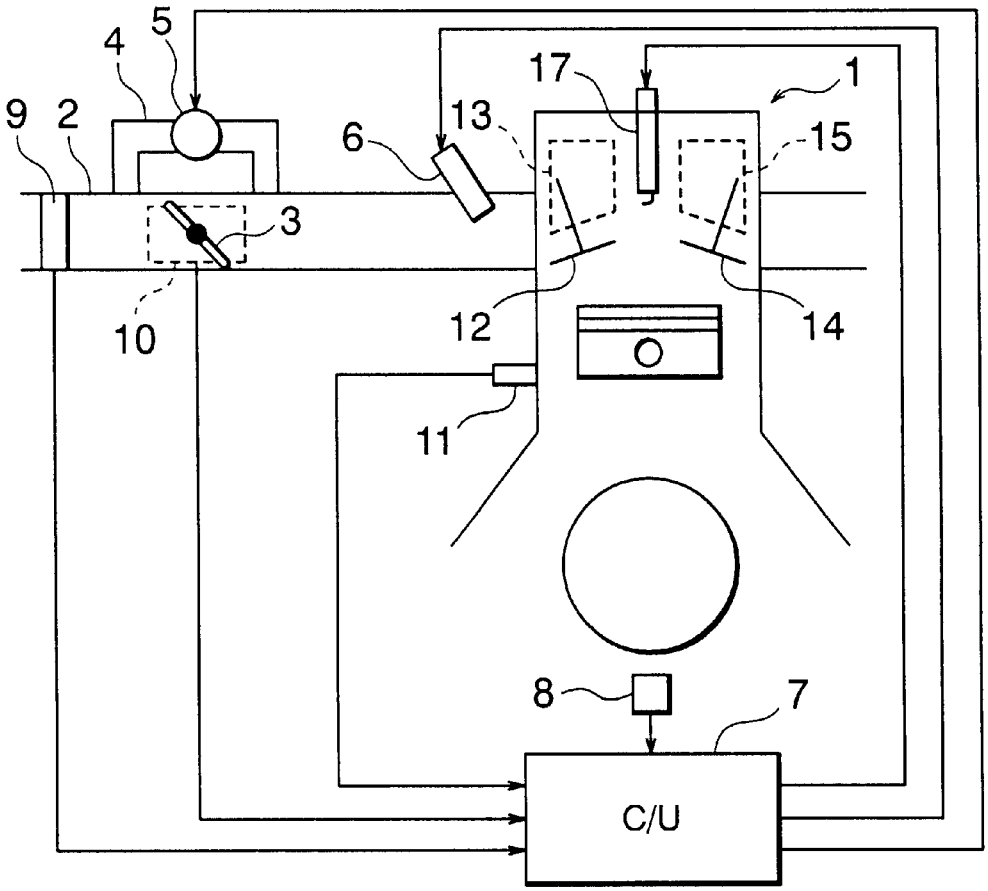
FIG. 1 shows an entire outline of an electromagnetic driving valve for an internal combustion engine according to a first embodiment of the present invention.

FIG. 1 shows a configuration of a system of an internal combustion engine according to a first embodiment of the present invention.

In FIG. 1, an intake path 2 of a 4-cycle internal combustion engine 1 is provided with a throttle valve 3 and an auxiliary air path 4 for bypassing the throttle valve 3. The auxiliary air path 4 is provided with an electromagnetic auxiliary air control valve 5.

When the 4-cycle internal combustion engine 1 is an engine (for example, a mirror cycle engine, etc.) capable of, for example, controlling the open/close period of an intake valve 12 by an electromagnetic driving valve device (electromagnetic driving valve) 13 described later to take in the air in an atmospheric pressure and control the amount of intake air without a throttle valve, the throttle valve 3, the auxiliary air path 4 and the auxiliary air control valve 5 can be omitted.

Furthermore, the intake port unit of the intake path 2 is provided with an electromagnetic fuel jet valve 6 for each cylinder. The fuel jet valve 6 provides a fuel (gasoline) for the engine. Signals are input from various sensors into a control unit (C/U) 7 containing microcomputer. Practically, a crank angle sensor 8 for outputting a reference angle signal Ref for each reference piston position and a unit angle signal Pos for each unit crank angle is provided, detects the position of a piston, and computes the rotating speed Ne of the engine.

The crank angle sensor 8 detects a detected unit formed on a signal plate making two rotations per engine (crank shaft) rotation, and is designed to determine a cylinder by outputting a signal of a different pulse width for each cylinder as the above mentioned reference angle signal Ref. However, the configuration for discrimination of a cylinder is not limited to the above mentioned configuration. The control unit (C/U) 7 includes a rotating speed detection means for detecting the rotating speed of a crank shaft based on the output of the crank angle sensor 8.

Furthermore, an air flow meter 9 for detecting the intake air flow Qa of the engine, a throttle sensor 10 for detecting the open level TVO of the throttle valve 3, a water temperature sensor 11 for detecting the cooling water temperature Tw of the internal combustion engine 1, etc. are provided. The control unit 7 controls the fuel jet by the fuel jet valve 6 based on the engine operation condition detected by various sensors, and controls the ignition timing by an ignition tap 17, and the electromagnetic driving valve devices 13 and 15 described later.

Figure 2:
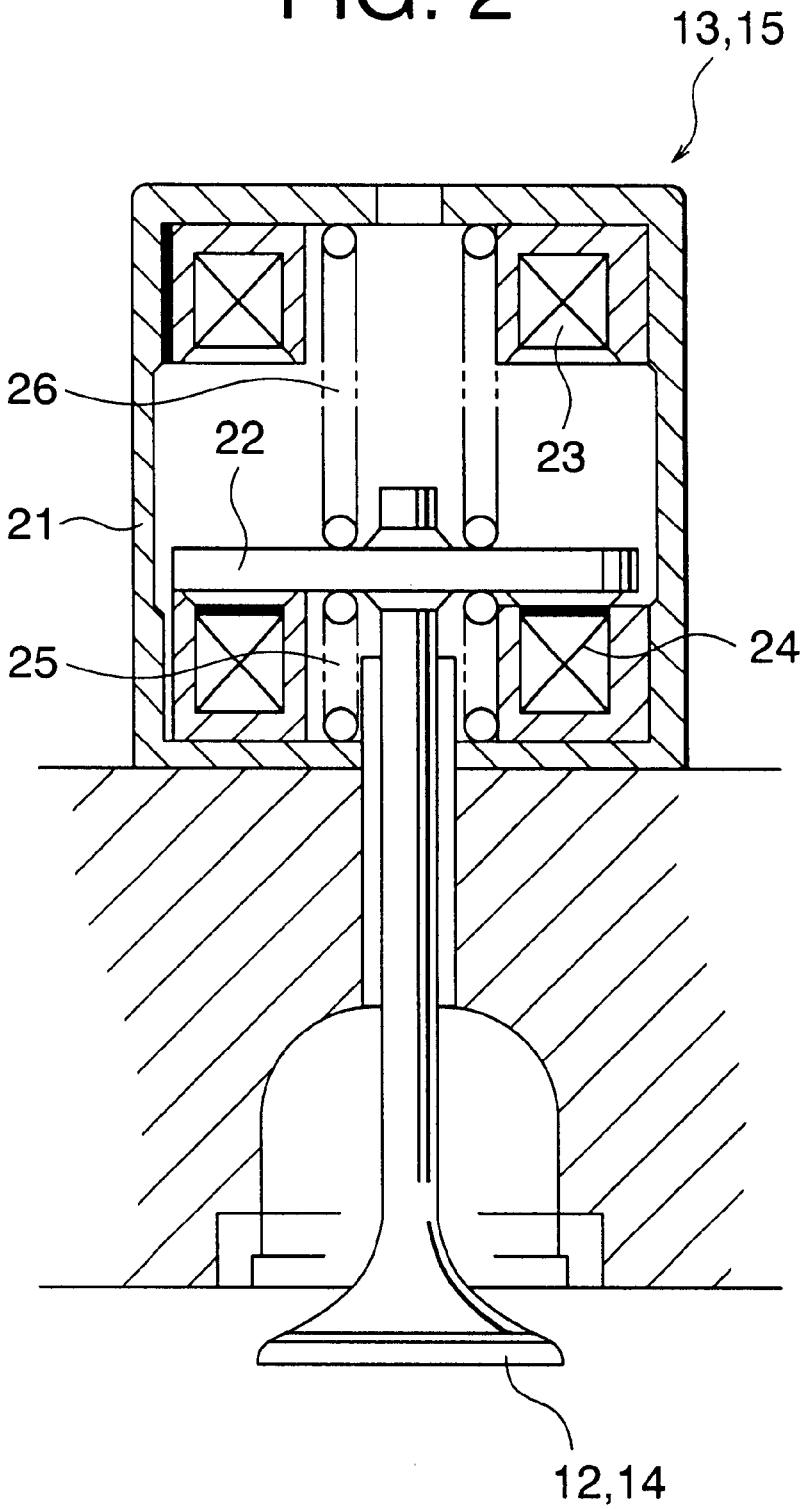
FIG. 2 is a sectional view showing a configuration of an electromagnetic valve used as an intake and exhaust valve.

Additionally, the internal combustion engine 1 is provided with the electromagnetic driving valve device 13 for driving the switch of the intake valve 12, and the electromagnetic driving valve device 15 as starting control means for switch driving an exhaust valve 14. FIG. 2 shows the configurations of the electromagnetic driving valve devices (electromagnetic driving valves) 13 and 15.

In FIG. 2, the electromagnetic driving valve devices 13 and 15 are configured by a housing 21 made of a non-magnetic material provided on a cylinder head; an armature 22 provided as incorporated into a stem 31 of the intake and exhaust valves 12 and 14 and stored as freely movable in the housing 21; an valve closing electromagnet 23 fixed in the housing 21 in the position opposing the top surface of the armature 22 such that an electromagnetic force can be generated for closing the intake and exhaust valves 12 and 14 by sucking the armature 22; an valve opening electromagnet 24 fixed in the housing 21 in the position opposing the bottom surface of the armature 22 such that an electromagnetic force can be generated for opening the intake and exhaust valves 12 and 14 by sucking the armature 22; a valve closing side feedback spring 25 (elastic material) for forwarding the armature 22 in the valve closing direction of the intake and exhaust valves 12 and 14; and a valve opening side feedback spring 26 (elastic material) for forwarding the armature 22 in the valve opening direction of the intake and exhaust valves 12 and 14. When the valve closing electromagnet 23 and the valve opening electromagnet 24 are both set in the power supply stop state, the spring force of the valve closing side feedback spring 25 and the valve opening side feedback spring 26 is set such that the intake and exhaust valves 12 and 14 can be supported with elasticity in the neutral position between the all-opened position and the all-closed position.

Figure 3:
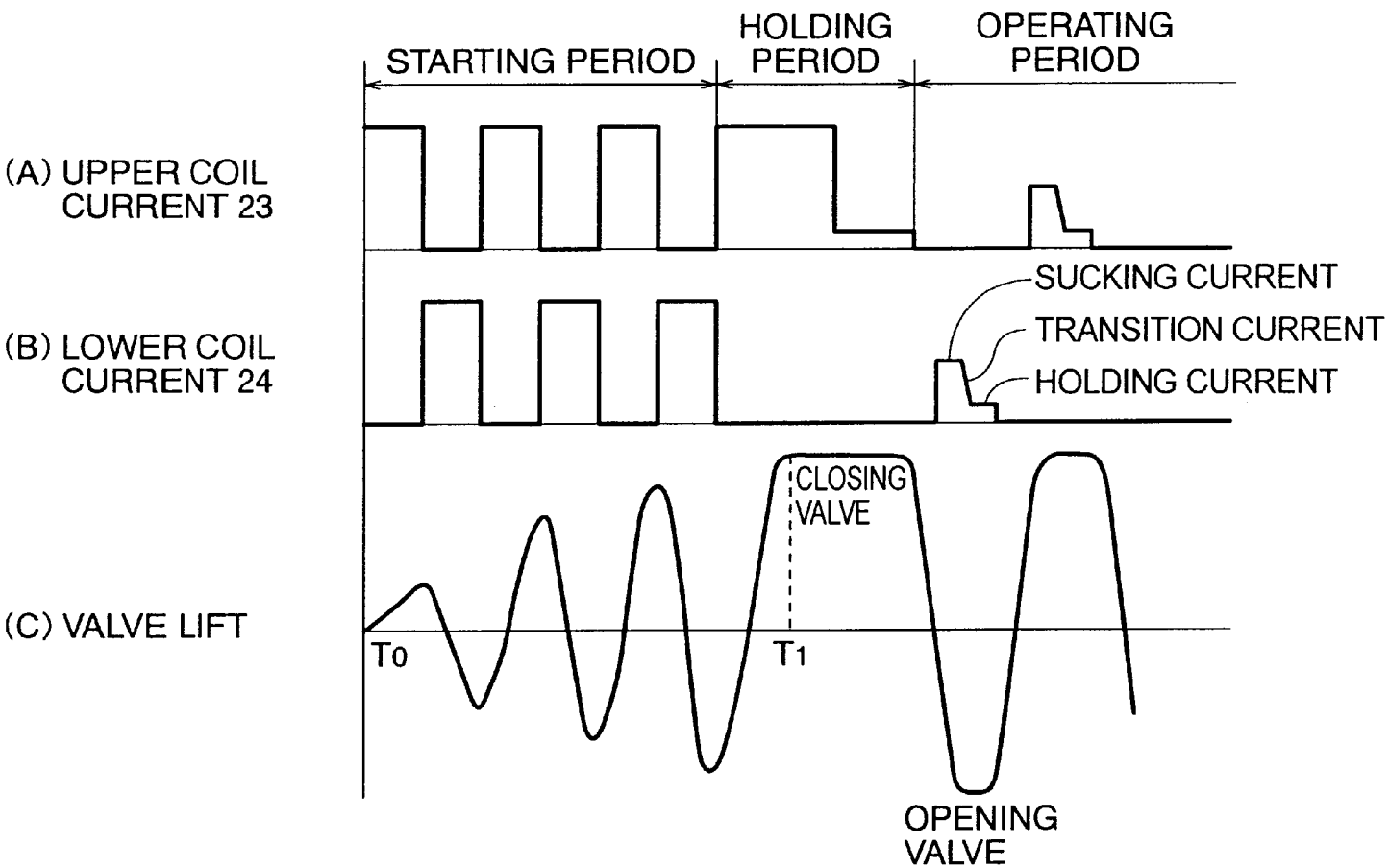
FIG. 3 is a time chart of an upper coil current (A), a lower coil current (B), and a valve lift (C)

FIG. 3 is a time chart showing the change with time of the current of the upper coil 23, the current of the lower coil 24, and the valve lift. The current is a drive command value issued by the ECU 7. As shown in FIG. 3, the drive of the electromagnetic valve is performed in the three actual operation period, that is, a starting period, a holding period, and an operating period. First, in the starting period, a resonance phenomenon is utilized to save power. That is, the current flows alternately through the upper coil and the lower coil as shown in FIGS. 3A and 3B in the period depending on the inherent vibration of the spring mass system containing a plunger as a mass such that an inherent valve vibration can be generated based on the neutral position in the power stop state. Then, the valve system gradually increases the amplitude from the neutral position as shown in FIG. 3C. Thus, using the resonance phenomenon, the electromagnetic force at the starting period, and the current for generation of the electromagnetic force can be reduced. As a result, power can be saved at the starting period, and the circuit configuration can be simplified.

In the holding period and the operating period, for example, in the all-closed position, the power supply to the valve opening electromagnet 24 is stopped, power is supplied to the valve closing electromagnet 23 to generate an electromagnetic force, and the armature 22 is adsorbed to the valve closing electromagnet 23. When the valve is opened from the above mentioned all-closed position, the power supply to the valve closing electromagnet 23 is stopped, the valve system is moved in the valve opening direction by the repulsive force of the valve opening side feedback spring 26, an electromagnetic force is generated by supplying power to the valve opening electromagnet 24 for the moving valve system, the armature 22 is adsorbed to the valve opening electromagnet 24, and the all-opened position is maintained.

Furthermore, when the valve is closed from the all-opened position, the power supply to the valve opening electromagnet 24 is stopped, the valve system is moved in the valve closing direction by the repulsive force of the valve closing side feedback spring 25, an electromagnetic force is generated by supplying power to the valve closing electromagnet 23 for the moving valve system, the armature 22 is adsorbed to the valve closing electromagnet 23, and the all-closed position is maintained. By repeating the above mentioned processes periodically, the function of the internal combustion engine as a valve driving device can be performed.

Figure 4:
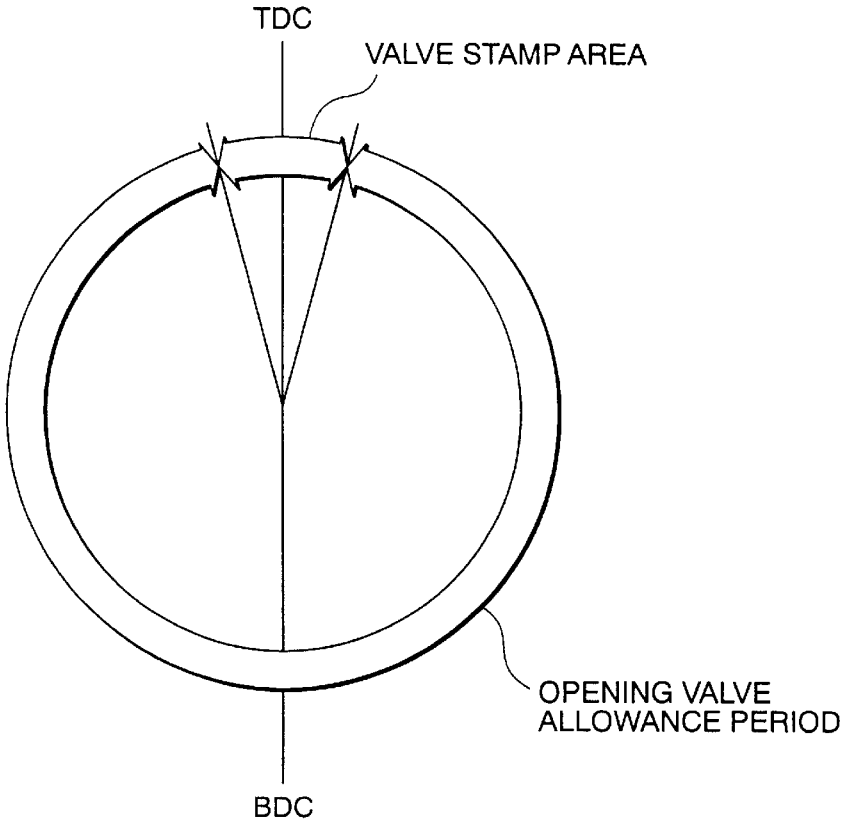
FIG. 4 shows a valve stamp area and a open valve allowance period.

The internal combustion engine is designed to have position of the top dead center of a piston interfere with the all-opened position of the valve system to improve the compression ratio. That is, there is a crank angle range in which the piston and the valve system can interfere with each other depending on the condition of the valve lift. When the crank angle range is defined as a valve stamp area, the valve stamp area has a crank angle range as shown in FIG. 4, and the crank angle range excluding the valve stamp area can be referred to as a valve opening allowance period. The valve stamp area is a constant crank angle range independent of the rotating speed.

Figure 5:
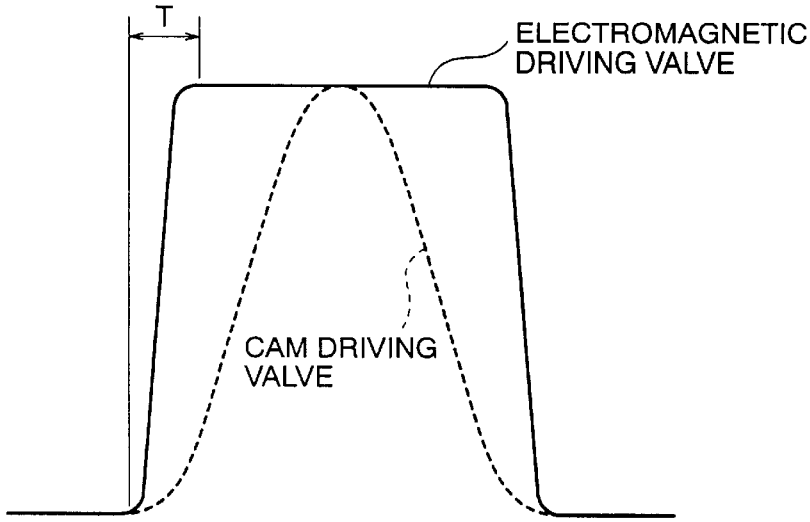
FIG. 5 shows a transition time from an all-closed position to an all-opened position or from the all-opened position to the all-closed position for an electromagnetic driving valve and a cam drive valve.

With the electromagnetic driving valve configured as a spring mass system, the transition time T from the all-closed position to the all-opened position, or from the all-opened position to the all-closed position is independent of the angular velocity of the crank shaft, but is obtained by the following equation dependent on the time, and is much shorter than that for the conventional cam driving valve as shown in FIG. 5.

$$T=\pi\sqrt{(M/K)} \quad (1)$$

In the equation (1) above, M indicates the weight of the movable portion, and K indicates a spring constant.

With a cam driving valve, the transition time is independent of time, but is dependent on the angular velocity of the crank shaft. Therefore, the difference in transition time becomes larger when the rotating speed is lower. Thus, considering the feature that the lift slope is steep independent of the crank angle, it is necessary to prevent the generation of a valve stamp with the electromagnetic driving valve.

Figure 6:
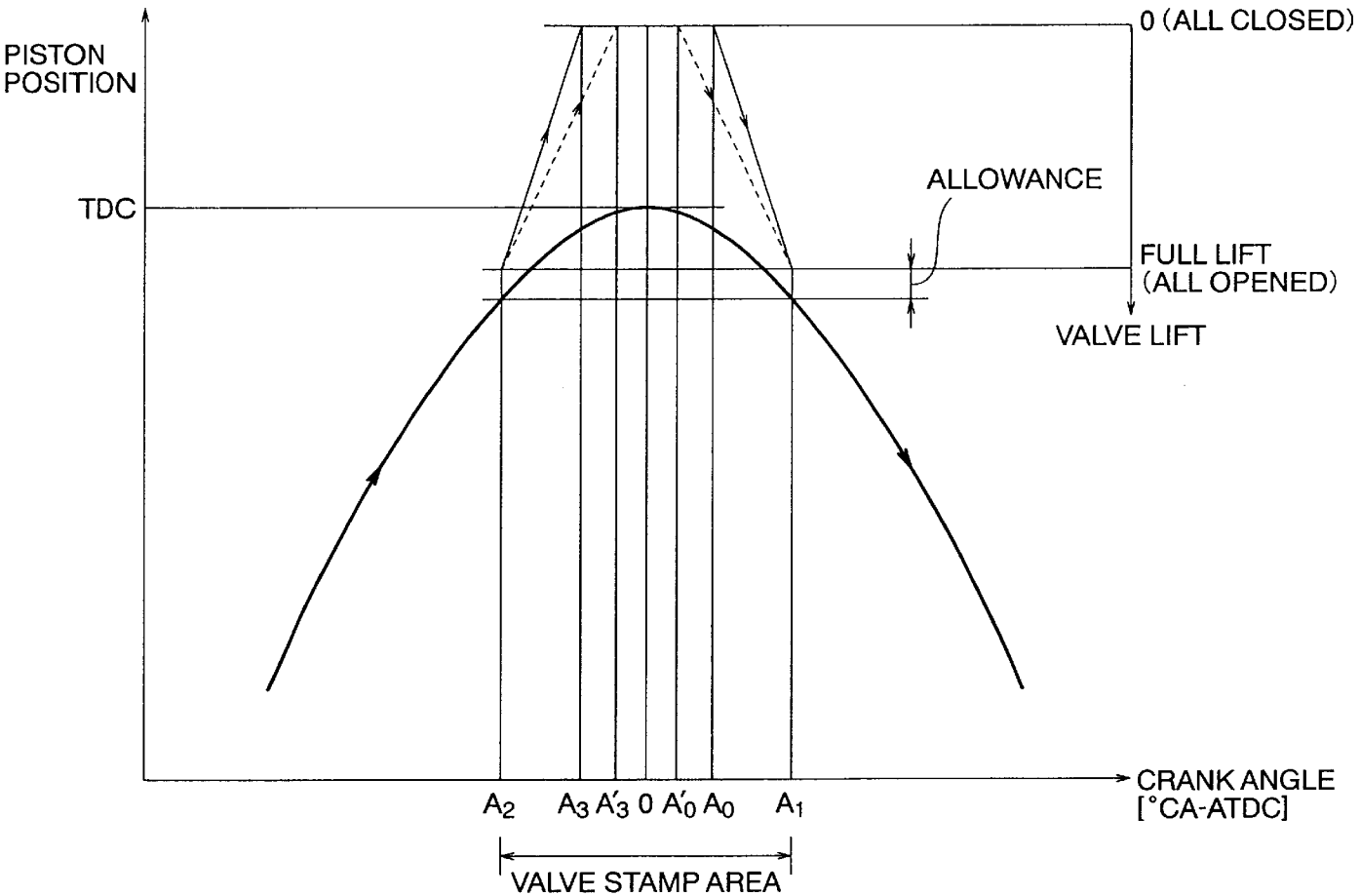
FIG. 6 shows a crank angle (crank angle after top dead center [° CA-ATDC]) and a relationship between a piston position and a valve lift.

FIG. 6 shows the relationship among the crank angle (crank angle after top dead center [° CA-ATDC]), the piston position, and the valve lift.

In FIG. 6, the valve stamp area is a crank angle range from A2 to A1 with a predetermined allowance taken into account. Therefore, to prevent the valve stamp, the process of driving in the valve closing direction is to be started when the crank angle position reaches A2. Since the time required to close a valve is constant as described above, the crank angle position A3 for the all-closed state changes with the rotating speed of the crank shaft. For example, when the rotating speed is higher, the position is transferred to the delay angle side, that is, from A3 to A3'.

Furthermore, the period in which the all-opened state can be entered soonest after top dead center is the point when the crank angle position reaches A1. Therefore, the crank angle position in which the process of driving from the all-closed state to the all-opened state can be started is the crank angle position A0 corresponding to the point of a predetermined time before A1. However, the crank angle position A0 changes with the rotating speed of the crank shaft. When, for example, the rotating speed is higher, the position is transferred to the forward angle side, that is, from A0 to A0' as shown in FIG. 6. If the rotating speed is higher, the two straight lines indicating the transition of the lift possibly cross each other.

As described above, to prevent the valve stamp when the electromagnetic driving valve is started using the inherent vibration of a spring mass system, A0 is the earliest starting period, and A2 is the latest starting period. Therefore, the period from A0 to A2 is referred to as a starting allowance period, and the starting time T0 can be set such that the time required for a starting operation 'T1–T0' (referred to as Tst) shown in FIG. 3 can be within the time range (starting allowance time) corresponding to the starting allowance period. At this time, the time required to reach the starting allowance time, that is, the crank angle position A0–A2 is dependent on the rotating speed (cranking speed) of the crank shaft when the engine is started. When the cranking speed is higher, it becomes shorter. Described below is the method of practically starting an electromagnetic valve.

Figure 7:
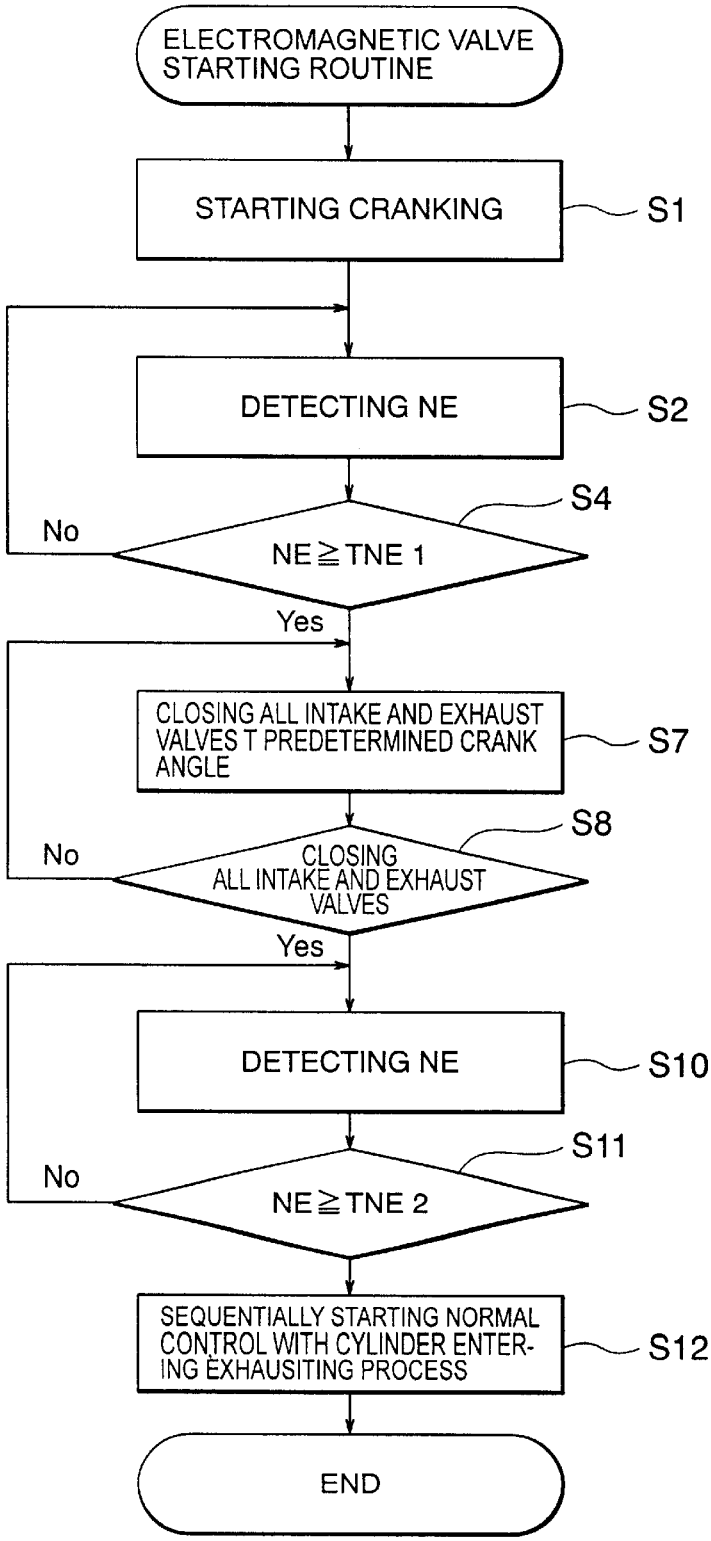
FIG. 7 is a flowchart of the procedure of a process of an electromagnetic valve starting routine according to the first embodiment of the present invention.

FIG. 7 is a flowchart of the procedure of processing an electromagnetic starting routine.

First, in step S1, a starter motor is driven, and the cranking operation is started. Then, in step S2, the rotating speed of the crank shaft, that is, the cranking speed NE is detected based on the output of the crank angle sensor 8. In step S4, it is determined whether or not the cranking speed NE has exceeded the first predetermined rotating speed TNE1. When the determination result is YES, control is passed to step S7.

Described below is the method of setting a first predetermined rotation number. Since power is not applied to intake and exhaust valves 12 and 14 after starting the cranking operation, the neutral position is maintained. Therefore, the piston is not performing a compressing or an expanding operation. However, when the intake and exhaust valves 12 and 14 are all closed, the compressing or expanding operations are started from that time point.

Figure 8:
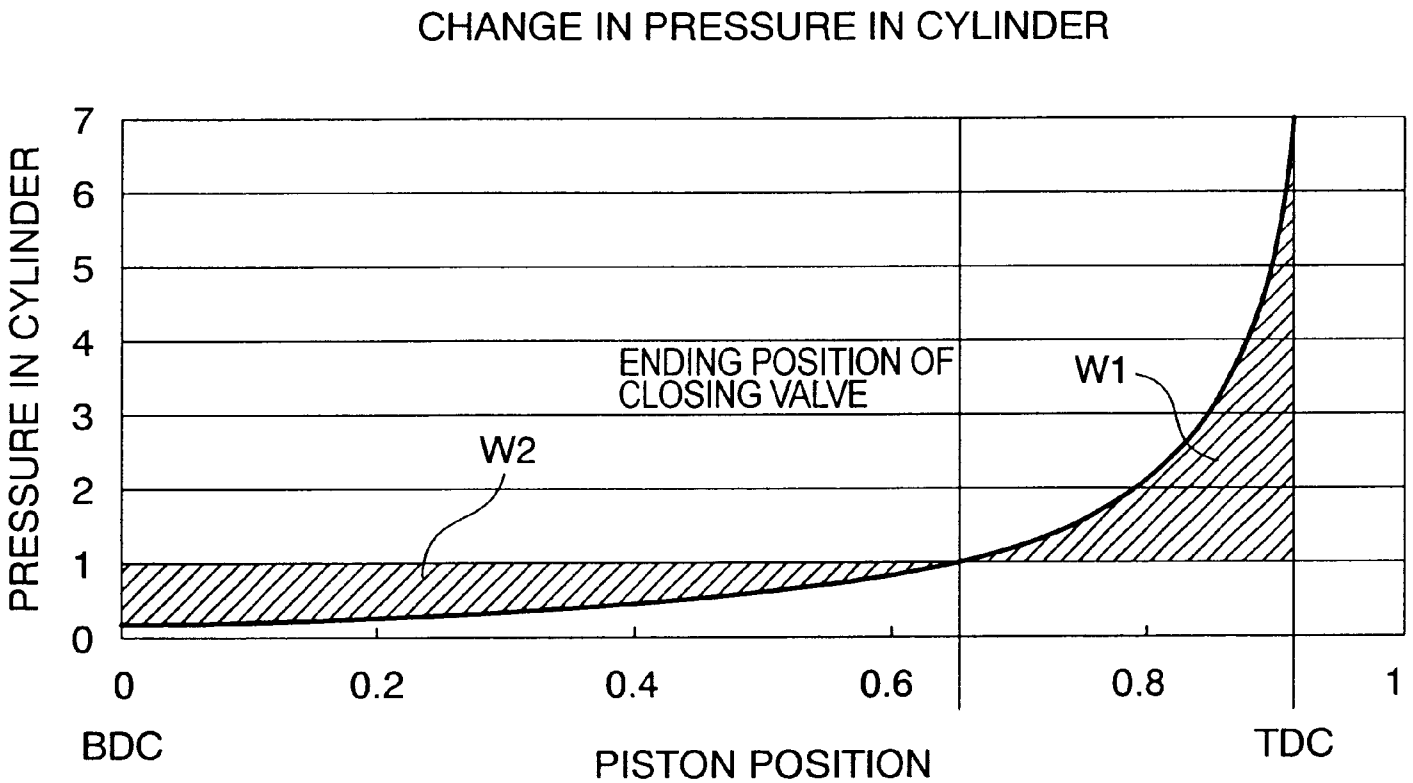
FIG. 8 is a graph showing the piston position and the change in internal pressure of a cylinder.

FIG. 8 is a graph showing the change in the pressure in the cylinder depending on the position of the piston.

When the last valve in the cylinder is closed, the compressing operation W1 or the expanding operation W2 starts with the rotation of the crank from this time (indicated with the ending position of closing valve in the drawing). Since the compressing operation or the expanding operation is provided depending on the integration of the force to the piston generated by the pressure in the cylinder, the area indicated by diagonal lines corresponds to an operation in FIG. 8.

If the crank rotating speed at this time is expressed by ω, and the inertial around the crank shaft is expressed by I, the rotation energy W expressed by the following equation is accumulated in the crank shaft.

$$W=I\omega^2/2 \quad (2)$$

If W>W1 and W>W2, the crank shaft can necessarily make one rotation. That is, the rotation energy larger than whichever is larger between the compressing operation W1 and the expanding operation W2 in one crank rotation is effective. Therefore, to avoid a valve stamp, the first predetermined rotating speed is to be lowest possible. Therefore, it is desired that the compressing operation W1 is substantially the same as the expanding operation W2. In the explanation above, there is one cylinder. However, if there are a number of cylinders, the operation amount per cylinder is multiplied by the number of cylinders to set the first predetermined rotating speed. After one rotation, the compression and expansion are repeated. Therefore, there is no operation of consuming a piston, thereby preventing the stop of the cranking operation by the compression or the expansion.

Considering the unevenness when the valve is closed, it is desired that the first predetermined rotating speed is set to a value obtained by adding a margin to the obtained predetermined rotating speed as described above. Since the compression and expansion are performed after the last valve in the cylinder is closed, the ending position of closing valve is set only for the last valve, and the valve closing positions of the other valves can be arbitrarily set at a no stamping position.

Next, the flowchart shown in FIG. 7 is described. In step S8, it is determined whether or not all valves have been closed. If the determination result is YES, then control is passed to step S10, and the cranking speed NE is detected as in step 2. Then, in step S11, it is determined whether of not the cranking speed NE has exceeded the second predetermined rotating speed TNE2. When the determination result is YES, control is passed to step S12. In step S12, normal control of intake and exhaust valves is sequentially started, thereby terminating the starting control routine. When control is passed to normal control, it is desired to start the exhaust valve opening control sequentially with the cylinder entering the exhausting process. It is obvious that the fuel control and the ignition control are started with the cylinder finishing the exhausting process and entering the intake process, thereby finally starting the internal combustion engine.

Thus, according to the present embodiment, the intake and exhaust valves are sequentially excited and started such that the all-closed position can be obtained at a predetermined crank angle after the rotating speed of the crank shaft has reached the first predetermined rotating speed at which the compressing and expanding operations can be obtained when all intake and exhaust valves are closed by the kinetic energy of a crank accumulated by rotation of a fly-wheel, a crank shaft, etc. incorporated into one structure after starting the cranking operation, all of the above mentioned intake and exhaust valves are closed, and the rotating speed of the crank shaft reaches an ignition point by the supply of a fuel, the open and close control of the intake and exhaust valve is started based on the processes of each cylinder under the condition over the second predetermined rotating speed at which a continuous engine operation can be continuously performed. Therefore, the compressing operation can be performed without giving an excess load to the starter, and no pumping loss is generated after all valves are closed, thereby quickly increasing the number of cranking revolutions, and quickly starting the engine.

Embodiment 2

Figure 9:
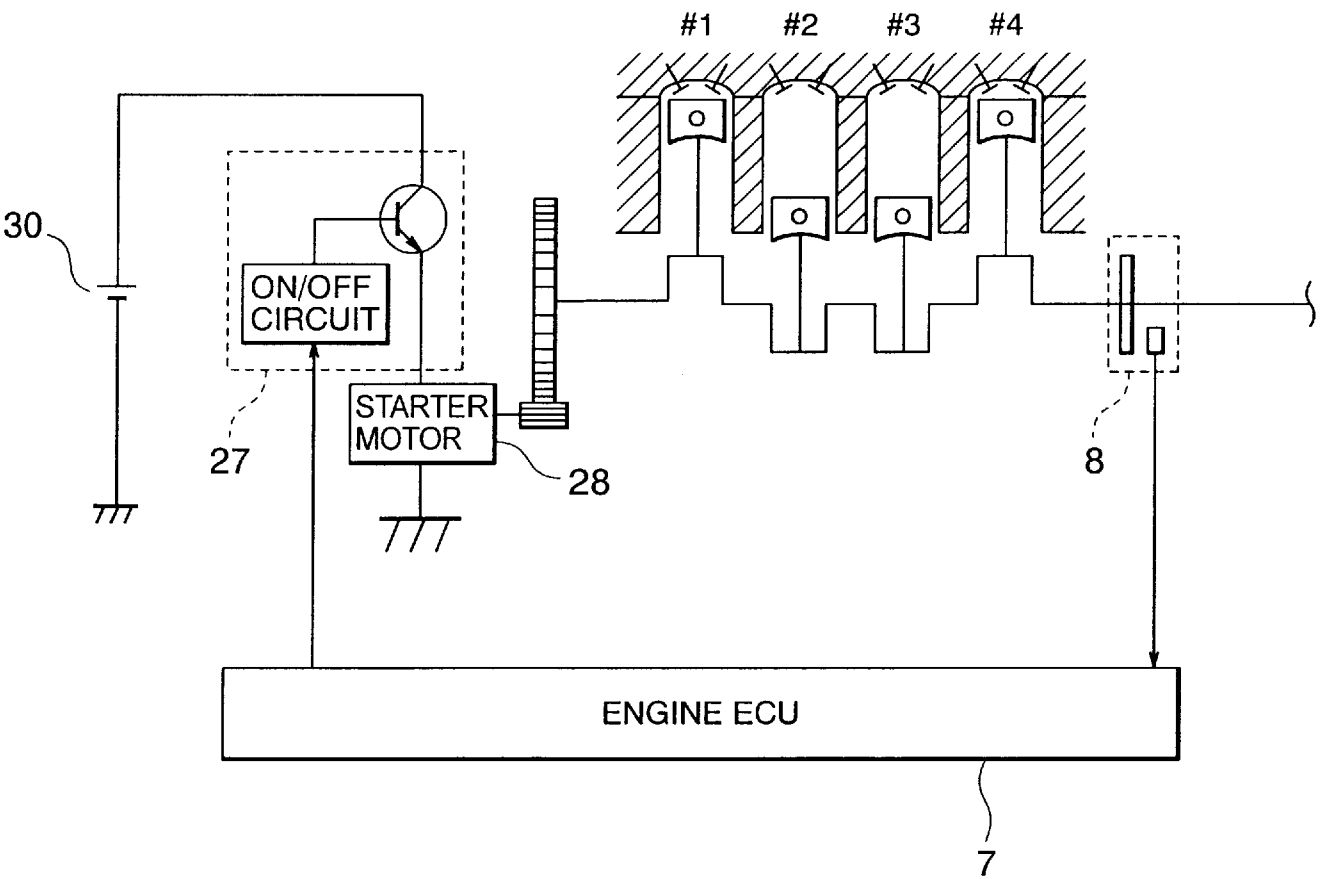
FIG. 9 shows a configuration of an engine starting device according to a second embodiment of the present invention.

FIG. 9 shows a configuration of a second embodiment of the present invention. In FIG. 9, the same or corresponding portions shown in FIG. 1 are assigned the same reference numerals, and the detailed explanation is omitted here.

In FIG. 9, reference numeral 28 denotes a starter motor, and receives power from a battery 30 through drive means 27 as first starter control means.

Figure 10:
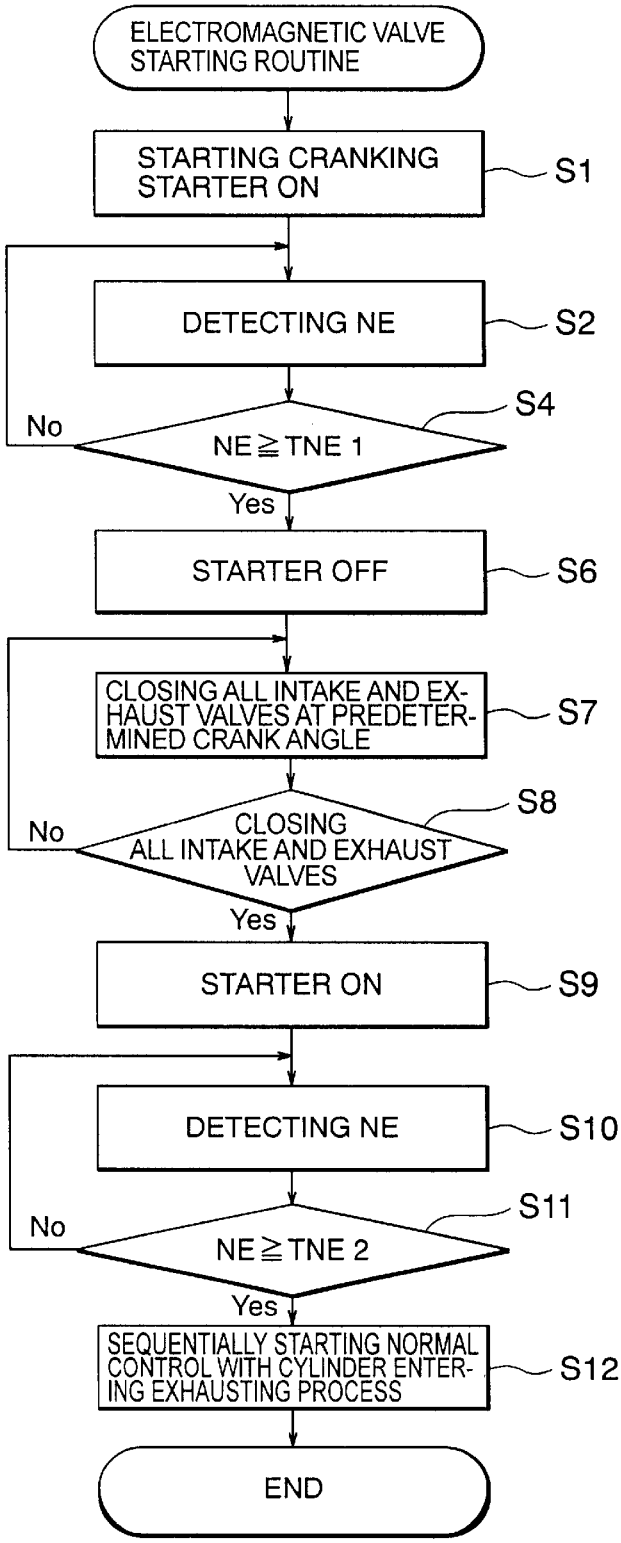
FIG. 10 is a flowchart of a procedure of a process of an electromagnetic valve starting routine according to the second embodiment of the present invention.

Then, the procedure of the process of the electromagnetic driving valve starting routine will be described below by referring to the flowchart shown in FIG. 10.

In step S1, the starter motor 28 is turned on, and the cranking is started. Then, in step S2, the rotating speed of the crank shaft, that is, the cranking speed NE is detected based on the output of the crank angle sensor 8. In step S4, it is determined whether or not the cranking speed NE has exceeded the first predetermined rotating speed TNE1. If the determination result is YES, then control is passed to step S6, and the starter is turned off. Then, in step S7, the intake and exhaust valves are sequentially closed as in the first embodiment. However, at the first predetermined rotating speed TNE1 as described in the above mentioned embodiment, the rotation energy required to close all valves is accumulated in the crank shaft. Therefore, the valves can be completely closed without driving the starter motor 28 and the load of the battery 30 can be reduced, and power can be applied sufficiently to the electromagnetic driving valve devices 13 and 15, thereby closing the intake and exhaust valves 12 and 14 without fail.

At this time, since a negative operation occurs by the friction resistance, etc. of the internal combustion engine 1, the predetermined rotating speed TNE1 is set considering this. Furthermore, since the water temperature sensor 11 removes the influence of the friction resistance, etc. of the engine 1 changing with the temperature, it is desired that the first predetermined rotating speed TNE1 is changed depending on the water temperature. That is, for example, when a load becomes larger, the value of the first predetermined rotating speed TNE1 is increased correspondingly. Therefore, the control unit (C/U) 7 has a target rotating speed amendment means for amending the first predetermined rotating speed TNE1 practically depending on the size of the load.

Then, in step S8, it is determined whether or not all valves have been closed. If the determination result is YES, then control is passed to step S9, the starter motor 28 is turned on again, and the cranking is resumed. Then, in step S8, as in step S2, the cranking speed NE is detected. Then, in step S9, it is determined whether or not the cranking speed NE has exceeded the second predetermined rotating speed TNE2. If the determination is YES, then control is passed to step S10. In step S10, the normal intake and exhaust valve controlling process is sequentially started, and the starting control routine is terminated. When the normal controlling process is started, it is desired that the exhaust valve opening control is started with the cylinder entering the exhausting process. Obviously, the fuel controlling process and the ignition controlling process are started with the cylinder which has finished the exhausting process and is entering the intake process, and the internal combustion engine is finally started.

Thus, according to the present embodiment, power is not applied to the starter while the intake and exhaust valves are driven from the neutral position to the all-closed position. Therefore, the load of the battery becomes smaller during the period, and power can be sufficiently applied to the intake and exhaust valves, thereby the starting control on the intake and exhaust valves can be guaranteed.

Furthermore, since the first predetermined rotating speed is set such that the load by a mechanical friction, etc. of an engine can be detected, and the kinetic energy can be reserved covering the negative operation amount by a load and the compressing and expanding operations occurring after all of the intake and exhaust valves have been closed, the crank shaft can rotate with the intake and exhaust valves all closed without the driving force of the starter even when the friction of the engine increases at a low temperature.

Embodiment 3

Figure 11:
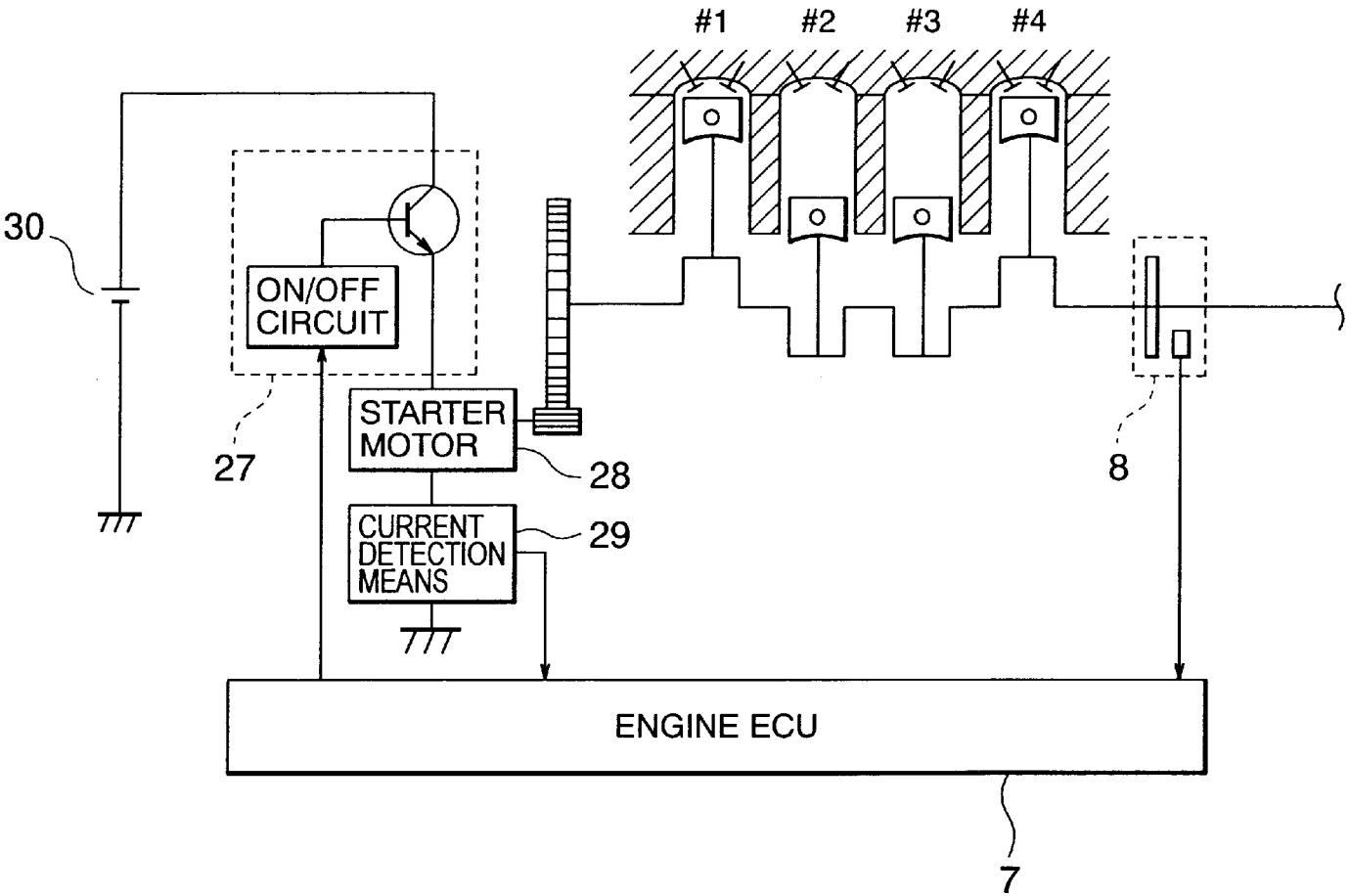
FIG. 11 shows a configuration of an engine starting device according to a third embodiment of the present invention.

FIG. 11 shows a the configuration showing a third embodiment of the present invention. In FIG. 11, the same or corresponding portions as in FIG. 1 are assigned the same reference numerals, and the explanation is omitted here.

In FIG. 11, reference numeral 28 denotes a starter motor to which power is applied from the battery 30 through the drive means 27. Reference numeral 29 denotes current detection means for detecting the current provided to the starter motor 28. The drive means 27 and current detection means 29 configure the second starter control means.

Figure 12:
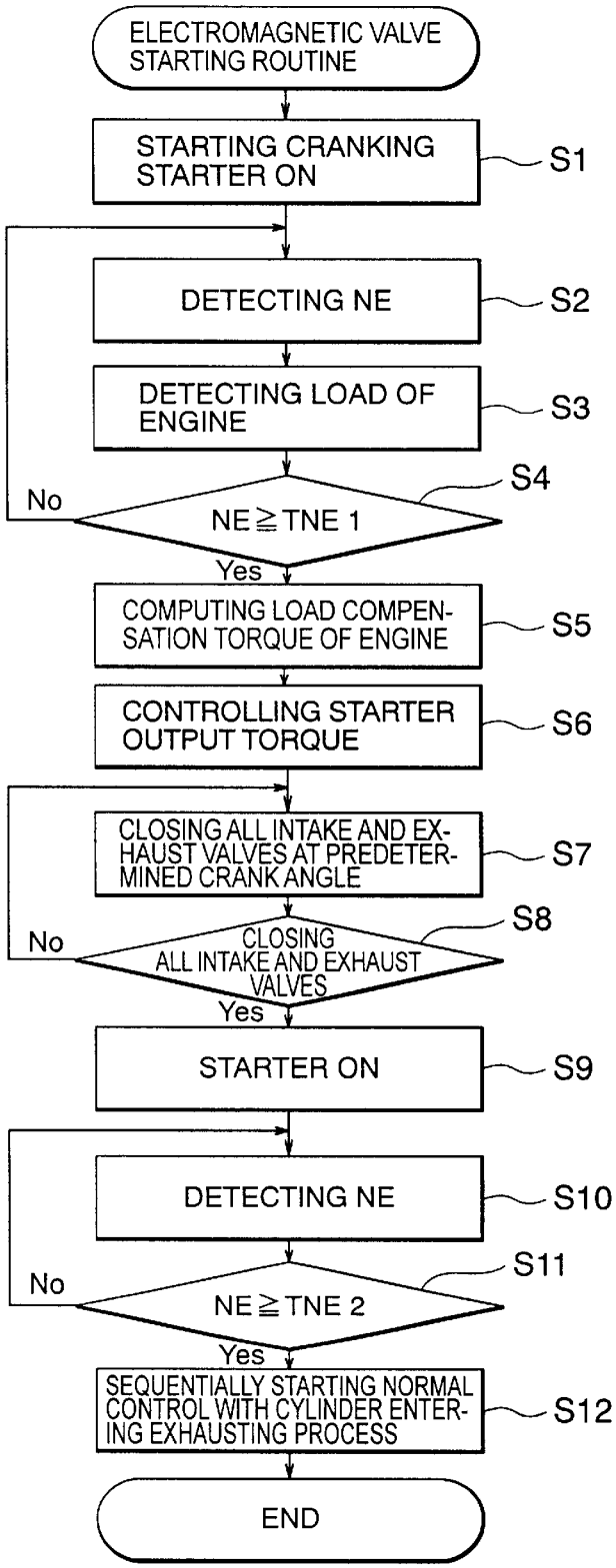
FIG. 12 is a flowchart of the procedure of the process of the electromagnetic valve starting routine according to the third embodiment of the present invention.

Then, the procedure of the process of the electromagnetic driving valve starting routine is described below by referring to the flowchart shown in FIG. 12.

First, in step S1, the starter motor 28 is turned on, and the cranking is started. Then, in step S2, the rotating speed of the crank shaft, that is, the cranking speed NE, is detected based on the output of the crank angle sensor 8. In step S3, the load of the engine is computed from the output torque of the starter motor 28, the acceleration of the detected cranking speed, and the inertia of the crank shaft (load detection means). That is, after the starting operation, the intake and exhaust valves 12 and 14 are in the neutral point. Therefore, the compressing or expanding operation is not performed. Therefore, the acceleration ω' of the cranking speed is expressed by the following equations where Ts indicates the output of a starter, Gc indicates the gear ratio to the crank shaft, I indicates the inertia of a crank shaft, and Te indicates the load torque of an engine.

$$\omega' = (Ts \cdot Gc - Te)/I \tag{3}$$

Therefore, the load torque Te also can be obtained by the following equation.

$$Te = I \cdot \omega' - Ts \cdot Gc \tag{4}$$

where the output torque Ts of the starter motor 28 is computed by the output of the current detection means 29. However, so far as the drive torque of the engine can be detected, other means for using a torque sensor, etc. can be used. Then, in step S4, it is determined whether or not the cranking speed NE has exceeded the first predetermined rotating speed TNE1. If the determination result is YES, then control is passed to step S5, and the compensation output torque Ts' of a starter 19 for compensation for the load torque Te of the engine obtained in step S3 is computed. That is, the computation is performed by the following equation.

$$Ts' = Te/G \tag{5}$$

Therefore, the control unit (C/U) 7 comprises load drive computation means for computing the output to the starter required to actually drive a load.

The target current of the starter motor 28 can be obtained by the current-torque characteristic of the starter motor 28. Then, in step S6, the starter motor 28 is controlled using the drive means 27 based on the compensation output torque Ts' of the starter motor 28 obtained in step S5. At this time, the drive means 27 is duty-controlled at an instruction from the ECU 7, but the control method is not specified.

Then, in step S8, the intake and exhaust valves are sequentially closed as in the above mentioned first embodiment. However, in the first predetermined rotating speed TNE1, the necessary rotation energy required to close all valves is accumulated in the crank shaft, and the starter motor 28 is driven by the driving force of compensating for the load torque of an engine. Therefore, the load of the battery 30 is reduced, and a sufficient power source is provided for the intake and exhaust valves 12 and 14, thereby completely closing the valves. Next, in step S8, it is determined whether or not all valves have been closed. If the determination result is YES, control is passed to step S9, and the starter motor 28 is driven again by the maximum driving force.

Then, in step S10, as in step S2, the cranking speed NE is detected. In step S11, it is determined whether or not the cranking speed NE has exceeded the second predetermined rotating speed TNE2. If the determination result is YES, control is passed to step S12. In step S12, the normal intake and exhaust valve control is sequentially started, and the starting control routine terminates. When control is passed to the normal control, it is desired to start the exhaust valve opening control starting with the cylinder entering the exhausting process. It is obvious that the fuel control and the ignition control are started with the cylinder entering the intake process, thereby finally starting the internal combustion engine.

Thus, according to the present embodiment, the load by the mechanical friction, etc. of an engine is detected, the starter output required to compensate for the negative operation amount by the load is computed, and the starter is driven by the starter output during the period from the start of closing valves to the end of closing valves for the intake and exhaust valve. Therefore, the load of the battery is reduced during the period, sufficient power can be provided for the intake and exhaust valves, and the operation related to the mechanical friction, etc. of an engine is performed by the starter. As a result, the crank and the intake and exhaust valves can be appropriately controlled for the starting process. When the friction of the engine increases, the crank shaft can rotate with all intake and exhaust valves closed without the driving force of the starter.

What is claimed is:

1. A method for controlling an electromagnetic driving valve for an internal combustion engine, comprising the steps of:

starting cranking of a crank shaft by a starter;

sequentially starting excitation of intake and exhaust valves such that the valves can be all closed at a predetermined crank angle after a rotating speed of a crank shaft has reached a first predetermined rotating speed;

starting switching control of an intake and exhaust valve according to a normal process of each cylinder under a condition of the intake and exhaust valves closed, and a rotating speed of the crank shaft exceeding a second predetermined rotating speed, and transferring to normal control.

2. The method for controlling an electromagnetic driving valve for an internal combustion engine according to claim 1, wherein said crank angle can be set such that the valve closing crank angle of a last closed electromagnetic driving valve in each cylinder can indicate substantially equal values between a compressed task amount and an expanded task amount from the crank angle.

3. The method for controlling an electromagnetic driving valve for an internal combustion engine according to claim 1, further comprising the step of prohibiting power supply to the starter from a starting time of closing the valve to an ending time of closing the valve for the electromagnetic driving valve.

4. The method for controlling an electromagnetic driving valve for an internal combustion engine according to claim 1, further comprising the step of amending the first predetermined rotating speed based on a level of a load of the engine.

5. The method for controlling an electromagnetic driving valve for an internal combustion engine according to claim 4, further comprising the steps of:

computing a necessary output to the starter to drive the load of the engine; and driving the starter based on the computed output from the starting time of closing valve to the ending time of closing valve for the electromagnetic driving valve.

6. The method for controlling an electromagnetic driving valve for an internal combustion engine according to claim 1, wherein said normal switching control of the intake and exhaust valve starts with an exhausting process.

7. An apparatus for controlling an electromagnetic driving valve for an internal combustion engine, supporting intake and exhaust valves in a neutral position with elasticity using an elastic material, and displacing the intake and exhaust valves into an all-closed position or an all-opened position using electromagnetic force, comprising:

rotating speed detection means for detecting the rotating speed of a crank shaft based on the output of a crank angle sensor; and start control means for controlling an intake and exhaust valve such that the intake and exhaust valve can maintain its all-closed status at a predetermined crank angle after the rotating speed of the crank shaft has reached a first predetermined rotating speed set in advance depending on a necessary task amount required to make a rotation of the crank shaft after the inertia around the crank shaft and the intake and exhaust valve has entered the all-closed state, wherein said switching control of the intake and exhaust valve is started depending on the normal process of each cylinder with the intake and exhaust valve maintained in its all-closed position, and the rotating speed of the crank shaft exceeding a second predetermined rotating speed.

8. The apparatus for controlling an electromagnetic driving valve for an internal combustion engine according to claim 7, wherein said crank angle is set such that the valve closing crank angle of the last closed electromagnetic driving valve in each cylinder can indicate substantially equal values between the compressed task amount and the expanded task amount from the crank angle.

9. The apparatus for controlling an electromagnetic driving valve for an internal combustion engine according to claim 7, further comprising first starter control means for prohibiting power supply to the starter from a starting time of closing valve to an ending time of closing the valve for the electromagnetic driving valve.

10. The apparatus for controlling an electromagnetic driving valve for an internal combustion engine according to claim 7, further comprising:

load detection means for detecting a level of a load of an engine; and target rotation speed amendment means for amending the first predetermined rotating speed based on the level of the load.

11. The apparatus for controlling an electromagnetic driving valve for an internal combustion engine according to claim 10, further comprising:

load drive computation means for computing a necessary output to the starter to drive the load; and second starter control means for driving the starter motor based on the computed output of the load drive computation means.

12. The apparatus for controlling an electromagnetic driving valve for an internal combustion engine according to claim 7, wherein said normal switching control of the intake and exhaust valve is started with the exhausting process.

* * * * *